United States Patent [19]

Garner, Jr. et al.

[11] Patent Number: 4,886,640

[45] **Date of Patent: * Dec. 12, 1989**

[54] HOT WORK TOOL STEEL WITH GOOD TEMPER RESISTANCE

[75] Inventors: Harrison A. Garner, Jr., Elverson; Raymond M. Hemphill, Wyomissing; John F. McGraw, Sinking Spring; Michael L. Schmidt, Reading; Bruce A. Smith, Reading; David E. Wert, Reading, all of Pa.

[73] Assignee: Carpenter Technology Corporation, Reading, Pa.

[ * ] Notice: The portion of the term of this patent subsequent to Aug. 1, 2006 has been disclaimed.

[21] Appl. No.: 234,901

[22] Filed: Aug. 22, 1988

[51] Int. Cl.[4] ..... C22C 38/24

[52] U.S. Cl. ..... 420/111; 148/334; 420/105

[58] Field of Search ..... 420/111, 105; 148/334

[56] References Cited

U.S. PATENT DOCUMENTS

| | | | |
|---|---|---|---|
| 1,496,979 | 6/1924 | Corning et al. | 420/111 |
| 1,496,980 | 6/1924 | Armstrong | 420/111 |
| 1,937,334 | 11/1933 | Emmons | 420/111 |
| 2,289,449 | 7/1942 | Nelson | 420/111 |
| 2,914,400 | 11/1959 | Roberts | 420/109 |
| 2,968,549 | 1/1961 | Brady et al. | 420/111 |
| 3,092,491 | 6/1963 | Payson et al. | 420/109 |
| 3,117,863 | 1/1964 | Roberts et al. | 420/111 |
| 3,128,175 | 4/1964 | Nagy et al. | 420/111 |

FOREIGN PATENT DOCUMENTS

| | | | |
|---|---|---|---|
| 541894 | 1/1977 | U.S.S.R. . | |
| 2065700 | 7/1981 | United Kingdom | 420/111 |

OTHER PUBLICATIONS

Data Sheet: *Carpenter No.* 883, Carpenter Technology Corp. (3/80).

Data Sheet: *AISI Type H*21, Alloy Digest, (7/71).

Table of Tool Steels, ASM Metals Handbook, vol. 3, p. 422, 9th Ed., (1980).

L. Norstrom, *Performance of Hot—Work Tool Steels,* Scan. J. of Met., (11/82).

L. Norstrom, M. Svenson, N. Ohrberg, *Thermal—Fatigue Behaviour of Hot—Work Tool Steels,* Met. Tech., (10/81).

L. Norstrom & N. Ohrberg, *Development of Hot—Work Tool Steel for High Temperature Applications,* Met. Tech., (1/81).

Data Sheet: *Thermold—H*10, Alloy Digest, (8/68).

Data Sheet: *Peerless* 56, Alloy Digest, (7/64).

Data Sheet: *Carpenter No.* 882, Carpenter Technology Corp., (8/81).

*Primary Examiner*—Deborah Yee

*Attorney, Agent, or Firm*—Dann, Dorfman, Herrell and Skillman

[57] ABSTRACT

An improved hot work tool steel has higher hardness capability and better temper resistance above 1100 F. and better wear resistance than AISI type H13 and better toughness and ductility then AISI type H10 or type H21. The steel alloy contains essentially the following in weight percent:

| | |
|---|---|
| Carbon | 0.55 Max. |
| Manganese | 1.5 Max. |
| Silicon | 2.0 Max. |
| Chromium | 3.5–6.0 |
| Molybdenum | 1.5–3.0 |
| Vanadium | 0.50–1.50 |

and the balance is essentially iron except for the usual impurities found in commerical grades of hot work tool steels. Carbon and chromium are balanced within the composition such that $\%\ \text{carbon} \geqq 0.098 \times \%\ \text{chromium}.$

23 Claims, No Drawings

HOT WORK TOOL STEEL WITH GOOD TEMPER RESISTANCE

BACKGROUND OF THE INVENTION

This invention relates to tool steels, and more particularly, to a hot work tool steel having a better combination of temper resistance, wear-resistance, and toughness than known hot work tool steels.

An important use for hot work tool steel is in the manufacture of tools for use in hot extrusion of metals. Such tools must operate under severe conditions of temperature, pressure and abrasive wear. The extrusion process includes forcing material in a plastic condition through a suitable restriction. Hot extrusion tools include dies or die assemblies through which the material is pushed to form a solid extruded shape, and mandrels which are used with such dies for the production of hollow products. An extrusion die must have high toughness combined with resistance to wear and softening at elevated temperatures since materials such as aluminum, copper and brass are usually extruded at elevated temperatures. For example, copper and brass are extruded in the range of 1200–2000 F. (650–1100 C.) whereas aluminum is extruded in the range of 800–1100 F. (425–600 C.). Mandrels for hot extrusion should have high hardness, abrasion resistance, toughness and yield strength at such elevated temperatures.

Heretofore, two hot work tool steels designated as AISI types H10 and H13, respectively have been used to provide mandrels and dies for the extrusion of metals such as aluminum, copper and brass. The two steels have good temper resistance, i.e., good resistance to heat softening, because of their medium chromium content and the presence of such carbide forming elements as molybdenum and vanadium. Those alloys have the following compositions in weight percent.

| | H10 | H13 |
|---|---|---|
| C | 0.35–0.45 | 0.32–0.45 |
| Mn | 0.25–0.70 | 0.20–0.50 |
| Si | 0.80–1.20 | 0.80–1.20 |
| Cr | 3.00–3.75 | 4.75–5.50 |
| Mo | 2.00–3.00 | 1.10–1.75 |
| V | 0.25–0.75 | 0.80–1.20 |
| Fe | Bal. | Bal. |

Included with the balance (Bal.) are the usual impurities present in commercial grades of hot work tool steels. Here and throughout this application, percent will be by weight unless otherwise indicated.

Type H13 alloy is known to have good toughness. It also has good wear resistance and temper resistance up to about 1100 F. (about 595 C.). However, above 1100 F. (about 595 C.), H13 loses substantial temper resistance and thus, leaves something to be desired when used in the extrusion of copper and brass where the extrusion temperatures are usually in the range of 1200–2000 F. (650–1100 C.).

Type H10 alloy has good temper resistance at elevated temperatures, i.e., above 1100 F. (about 595 C.), as well as good wear resistance. However, Type H10 alloy does not have the desirable toughness and ductility exhibited by Type H13 alloy. H10 is a more brittle alloy and is not preferred for use in applications where good toughness and ductility are desired, for example in extrusion mandrels.

AISI type H21 alloy is a hot work tool steel having the following composition:

| | |
|---|---|
| C | 0.25–0.37 |
| Mn | 0.10–0.40 |
| Si | 0.15–0.50 |
| Cr | 3.00–3.75 |
| W | 8.50–10.00 |
| V | 0.20–0.60 |

and the balance essentially iron. Type H21 alloy is used to provide dies and mandrels for the extrusion of copper, brass, and steel because of its high hardness and good temper resistance. However, type H21 alloy has less than desirable ductility and toughness compared to type H13 alloy. Also, due to its high tungsten content, type H21 alloy cannot be water cooled in service.

Applicants' copending application Ser. No. 875,648, assigned to the assignee of the present application relates to a hot work tool steel alloy containing:

| | |
|---|---|
| C | 0.35–0.5 |
| Mn | 1.0 max. |
| Si | 2.0 max. |
| Cr | 5.7–7.0 |
| Mo | 1.65–2.2 |
| V | 0.6–1.1 |

and the balance essentially iron. The alloy has better toughness than Type H13 when air cooled in large section sizes, e.g. greater than 6-inch (15.24 cm) round. The alloy also exhibits better wear resistance than Type H13 and has excellent hardness and strength, but above 1100 F. (about 595 C.) it has reduced temper resistance compared to the Type H10 and H21 alloys.

SUMMARY OF THE INVENTION

It is a principal object of this invention to provide a hot work tool steel having higher as-tempered hardness and better temper and wear resistance than AISI Type H13 alloy, while its remaining physical properties, especially toughness and ductility, are at least comparable thereto.

Another object of this invention is to provide such an alloy having better toughness and wear resistance than Type H10 alloy while having temper resistance at least comparable thereto.

A further object of this invention is to provide an alloy having better ductility and toughness than Type H21 alloy while its temper resistance is at least comparable thereto.

The foregoing objects, as well as additional advantages of this invention, are achieved to a significant measure by providing a tool steel having the following composition:

| | Broad | Intermediate | Preferred |
|---|---|---|---|
| Carbon | 0.55 max. | 0.32–0.55 | 0.35–0.45 |
| Manganese | 1.5 max. | 1.5 max. | 0.30–0.60 |
| Silicon | 2.0 max. | 2.0 max. | 0.90–1.10 |
| Chromium | 3.5–6.0 | 3.50–5.75 | 3.75–5.00 |
| Molybdenum | 1.5–3.0 | 1.65–2.60 | 1.80–2.25 |
| Vanadium | 0.50–1.50 | 0.55–1.25 | 0.60–1.00 |

wherein % carbon $\geqq 0.09 \times$ % chromium. Tungsten can be substituted for up to 0.25% molybdenum in the ratio 2:1 by weight percent. The remainder of the alloy is essentially iron which is intended to include optional elements and the usual impurities found in commercial grades of such alloys. Such elements may be present in amounts varying from a few hundredths of a percent as in the case of phosphorus or sulphur to larger amounts of other elements which do not objectionably detract from the desired properties of the composition. Thus, up to about 0.025% each of phosphorus and sulfur may be present although each is preferably limited to no more than about 0.015%. However, when desired, free machining additives, such as up to about 0.10% sulfur, are included to improve machinability.

The foregoing tabulation is provided as a convenient summary and is not intended thereby to restrict the lower and upper values of the ranges of the individual elements of the alloy of this invention for use solely in combination with each other or to restrict the broad, intermediate or preferred ranges of the elements for use solely in combination with each other. Thus, one or more of the broad, intermediate and preferred ranges can be used with one or more of the other ranges for the remaining elements. In addition, a broad, intermediate or preferred minimum or maximum for an element can be used with the maximum or minimum for that element from one of the remaining ranges.

DETAILED DESCRIPTION

Chromium contributes to the hardenability of this composition and permits the attainment of good toughness. Chromium also adds to the oxidation resistance of the alloy. Accordingly, at least about 3.5%, preferably at least about 3.75%, chromium is present in this alloy. Excessive chromium adversely affects the temper resistance and wear resistance of the composition. Also, excessive chromium promotes the undesirable retention of austenite during quenching from the austenitizing temperature. Therefore, chromium is limited to no more than about 6.0%, better yet, to no more than about 5.75%, and preferably to no more than about 5.00% in this composition.

Molybdenum contributes to the hardness capability of the composition. It also benefits the temper resistance and the hardenability of the alloy. Accordingly, at least about 1.5%, better yet at least about 1.65%, and preferably at least about 1.80%, molybdenum is present in this alloy. As the amount of molybdenum is increased the benefit derived does not proportionately increase and the toughness of the alloy is adversely affected. Thus, too much molybdenum may unnecessarily increase the cost of the alloy. Therefore, molybdenum is limited to no more than about 3.0%, better yet to no more than about 2.60%, and preferably to no more than about 2.25%, in this composition.

Vanadium is beneficial to the temper resistance and the secondary hardening response of this composition. Vanadium adds wear resistance and contributes to the alloy's toughness by forming vanadium carbides which help maintain a relatively fine grain structure. Accordingly, at least about 0.50%, better yet at least about 0.55%, and preferably at least about 0.60%, vanadium is present to attain the good temper resistance and wear resistance which are characteristic of this alloy. Excessive vanadium, however, tends to tie up too much carbon, thereby leading to reduced hardness capability in the as-tempered condition. Therefore, no more than about 1.50%, better yet no more than about 1.25%, and preferably no more than about 1.00%, vanadium is present in this alloy.

Carbon is present in this composition to provide the good wear resistance and hardness capability, i.e., peak attainable hardness, which are characteristic of the present invention. Carbon also contributes to the hardenability of the alloy. Accordingly, at least about 0.32% is preferably present, and for best results at least about 0.35% carbon is present. Too much carbon adversely affects the toughness of this composition, however. Carbon is therefore limited to about 0.55% max. and preferably to about 0.45% max. To ensure the attainment of the desired high hardness and wear resistance, while maintaining good toughness, carbon and chromium should be balanced in accordance with the relationship:

$$\% \text{ carbon} \geqq 0.09 \times \% \text{ chromium}.$$

A small but effective amount of tungsten, up to about 0.50%, may be substituted for up to about 0.25% molybdenum in the ratio 2:1 by weight percent in the present alloy. When present, in place of molybdenum, tungsten adds to the temper resistance of the alloy. Tungsten also forms tungsten carbides which help to control grain size during austenitization thereby benefitting the toughness of the alloy. Tungsten in excess of the stated amount leads to embrittlement of the alloy which adversely affects its ability to be water cooled in service, i.e., while at elevated temperature. Furthermore, tungsten does not provide a significant beneficial effect on temper resistance or wear resistance except when substituted for molybdenum as previously indicated. Accordingly, tungsten is not generally cost effective in this alloy and preferably no more than a residual amount is present.

Manganese is preferably present in this alloy because it contributes to the hardenability, i.e., the depth of hardening, of the alloy. When present manganese is limited to about 1.5% max. because more than that amount adversely affects the temper resistance of the alloy. Preferably, about 0.30–0.60% manganese is present and, for best results, about 0.40–0.50% manganese is present in this alloy.

Silicon also is preferably present in this alloy because it too contributes to the hardenability of the composition and, more importantly, silicon benefits the secondary hardening response of the alloy. When present, silicon is limited to about 2.0% max. because it is a strong ferrite former. Preferably, about 0.90–1.10% silicon is present.

For improved machinability up to about 0.10% sulfur may be included, if desired, or an equivalent amount of one or more other well known free machining additives to tool and die steels.

This alloy does not require any unusual preparation and may be made using conventional, well-known techniques. The preferred commercial practice is to prepare a heat using the electric arc furnace, refine it using the known argon-oxygen decarburization (AOD) practice and then cast the heat in the form of electrodes. The electrodes are then remelted in an electroslag remelting (ESR) furnace. The alloy is preferably hot worked from a furnace temperature of about 1900–2100 F. (about 1035–1150 C.) and air cooled. Annealing or stress relieving is carried out by heating to about 1550–1650 F. (about 850–900 C.) for up to 10 hours, depending upon the size of the hot worked article, cooling slowly in the furnace at the rate of about 10–20 F°. (about 5–10 C°.) per hour to about 1100 F. (about 595 C.) followed by cooling in air.

Hardening is carried out by heating the alloy to the desired austenitizing temperature in the range 1875 F. to 1925 F. (about 1025–1050 C.), preferably about 1900 F. (about 1035 C.). The alloy is quenched from the austenitizing temperature at a rate sufficient to achieve a fully martensitic microstructure. The alloy is preferably quenched in oil from the austenitizing temperature. In the as-quenched condition, the alloy should be essentially free of bainite, i.e. preferably no more than about 10% bainite. Articles smaller than about 2 inches in major cross-sectional dimension can be quenched by cooling in air.

Tempering is preferably carried out by holding at about 1100 F. (about 595 C.) for 2 hours+2 hours (two successive heat treatments each of two-hour duration). When tempered at a temperature other than 1100 F. (595 C.) the duration of tempering is preferably adjusted to be equivalent to 1100 F. (595 C.) for 2 hours+2 hours in accordance with the Larson-Miller parameter: (460 F.+T) (20+log t), where T is the tempering temperature in F and t is the duration in hours. When thus hardened and tempered, the attainable hardness of this composition is at least about 50 HRC; room temperature transverse Charpy V-notch impact strength at mid-radius is at least about 5 ft-lb; and wear loss, as measured by ASTM Practice G65, method A, is less than about 130 $mm^3$. The composition can be formed into various articles including billets, bars and rods. In the heat treated condition the alloy is suitable for use in hot extrusion tools such as dies, mandrels and the like.

EXAMPLE

As an example of the present invention, an electric arc melted heat having the composition in weight percent shown in Table I was prepared and refined by AOD. The heat was cast into 10 inch round electrode ingots. The electrode ingots

TABLE I

| | |
|---|---|
| C | 0.40 |
| Mn | 0.48 |
| Si | 0.99 |
| P | 0.014 |
| S | 0.002 |
| Cr | 4.45 |
| Ni | 0.14 |
| Mo | 2.05 |
| Cu | 0.03 |
| Co | 0.02 |
| Ti | 0.003 |
| Cb | <0.01 |
| W | 0.02 |
| V | 0.70 |
| Al | 0.029 |
| Fe | Bal. |

were stress relieved by heating up to 1400 F. and then cooling in place in the furnace. The electrode ingots were ESR remelted into 17 inch round ingots. The 17 inch ingots were homogenized at 2300 F. and then rotary forged from a temperature of 2000–2050 F. to 6.656 inch round bars which were each hot cut into three segments. The bar segments were air cooled to 400 F. and then annealed as follows: heat at 1620 F. for 10 hours followed by furnace cooling at 20 F.°/h to 1100 F. and then air cooled. The bar segments were each finish machined to 6.25 inch round. Two of the finished bars were hot rolled to 3.125 inch round, air cooled to 400 F., and then annealed the same as the 6.25 inch round bar segments. The 3.125 inch round bars were then finish machined to 3.00 inch round.

A tempering survey was performed to evaluate the temper resistance of the present composition. Cube samples ½ inch on a side were cut from the mid-radius location of a 6.25 inch round bar. The cube samples were austenitized in salt at 1900 F. for 25 minutes and air cooled. Air cooling of such small samples is effectively the same as oil quenching a larger section size, e.g., greater than 2 inch in diameter. Individual samples were then tempered as shown in Table II. The as-tempered hardness readings indicated in Table II for each sample are given as Rockwell C scale hardness (HRC) and represent the average of five readings on each sample.

TABLE II

| Tempering Temp. (°F.) | HRC @ 2 h | HRC @ 2 h + 2 h |
|---|---|---|
| 900 | 55.0 | 55.5 |
| 1000 | 56.0 | 56.5 |
| 1050 | 54.5 | 53.5 |
| 1100 | 52.5 | 50.5 |
| 1150 | 48.5 | 45.5 |
| 1200 | 41.5 | 37.5 |

Table II shows the good temper resistance of the alloy of the present invention when exposed to temperatures above 1100 F.

Longitudinal (L) Charpy V-notch impact specimens were machined from the mid-radius location of the annealed 6.25 inch bar and from the annealed 3.00 inch bar. Transverse (T) specimens were taken from the mid-radius and center of the 6.25 inch bar and from the near center of the annealed 3.00 inch bar. All samples were austenitized in salt for 25 minutes at 1900 F., air cooled, and then tempered at 1100 F. for 2 hours plus 2 hours. The results of Charpy V-notch impact tests (CVN) at room temperature (R.T.) and at 800 F. are shown in Table IIIA for the 6.25 inch bar samples and in Table IIIB for the 3.00 inch bar samples together with the measured hardness of the specimen (HRC). Impact values are given in ft-lb for duplicate samples taken from the ingot top (Top), bottom (Bot.) and middle (Mid.).

TABLE IIIA

| | | Longitudinal | | | Transverse | | |
|---|---|---|---|---|---|---|---|
| Temp. | Loc. | CVN | (ft-lb) | HRC | CVN | (ft-lb) | HRC |
| R.T. | Top | 8.9, | 9.4 | 51.5 | 5.1, | 7.6 | 51.5 |
| | Top* | — | — | — | 6.7, | 4.7 | 51.5 |
| | Bot. | 10.4, | 9.6 | 51.0 | 7.9, | 6.4 | 51.0 |
| | Bot.* | — | — | — | 6.2, | 7.2 | 51.0 |
| | Mid | 8.3, | 8.5 | 51.5 | 5.7, | 5.2 | 51.5 |
| | Mid* | — | — | — | 2.8, | 3.9 | 51.5 |
| 800 F. | Top | 17, | 20 | 51.5 | 14, | 15 | 51.5 |
| | Bot. | 20, | 19 | 51.0 | 14, | 15 | 51.0 |
| | Mid. | 17, | 18 | 51.5 | 11, | 12 | 51.0 |

*Test specimen taken from diametric center of the bar for comparison.

TABLE IIIB

| | Bar | Longitudinal | | | Transverse | | |
|---|---|---|---|---|---|---|---|
| Temp. | Size | CVN | (ft-lb) | HRC | CVN | (ft-lb) | HRC |
| R.T. | 3.00" rd. | 11.2, | 11.5 | 51.0 | 9.0, | 7.7 | 51.5 |
| 800 F. | 3.00" rd. | 22, | 22 | 51.0 | 12, | 12 | 51.0 |

Tables IIIA and IIIB illustrate the combination of good toughness and high hardness provided by the alloy of the present invention at both room and elevated temperatures. The diametric center transverse CVN data for the 6.25 inch bar is shown for comparison purposes only. The lower values result from the inhomogenous nature of the alloy in that region. The additional hot working performed on the 3.00 inch bar significantly improves the homogeneity and thus the toughness of the composition at the diametric center as shown by the data in Table IIIB.

Wear test blanks 1 inch by 3 inch by ¼ inch machined from the annealed 6.25 inch and 3.00 inch bars were austenitized in salt for 25 minutes at 1900 F., air cooled, and then tempered at 1100 F. for 2 hours plus 2 hours.

Wear testing was carried out in accordance with ASTM test G65, Method A. The wear test results are shown in Table IV as the volume of lost material (Vol. Loss). A smaller volume loss indicates better wear resistance. Hardness values taken on all samples after testing are also given in Table IV as HRC.

TABLE IV

| Bar Size | Vol. Loss ($mm^3$) | | HRC |
|---|---|---|---|
| 3.00 in | 129.2, | 122.3 | 51.0 |
| 6.25 in | 119.6, | 123.7 | 51.0 |

The data of Table IV illustrate the good wear resistance of the present alloy. By way of comparison, type H13 alloy when similarly prepared, hardened and tempered exhibits a wear loss of about 135–140 $mm^3$ in the same test.

Standard 0.252 inch diameter tensile specimens were machined from the annealed 6.25 inch and 3.00 inch bars. Longitudinal (L) and transverse (T) specimens were taken from the 6.25 inch bar, whereas only transverse specimens were taken from the 3.00 inch bar. All of the specimens wre austenitized in salt for 25 minutes at 1900 F., air cooled, and then tempered at 1100 F. for 2 hours plus 2 hours. Tensile testing was performed at room temperature and at 800 F. The results of the tensile and ductility tests are shown in Table V, including the 0.2% offset yield strength (0.2% Y.S.) and the ultimate tensile strength (U.T.S.) in ksi, as well as the percent elongation in 4 diameters (% El.) and the reduction in area (R.A. %). Hardnesses measured on each sample after tensile testing are given as HRC.

TABLE V

| Bar Size | L/T | Temp. | HRC | (ksi) 0.2% Y.S. | (ksi) U.T.S. | % El. | % RA |
|---|---|---|---|---|---|---|---|
| 3.00 in. | L | R.T. | 51.5 | 238.6 | 270.0 | 9.0 | 42.4 |
| | | | 51.5 | 238.6 | 270.8 | 9.2 | 43.6 |
| | | | 51.5 | 238.6 | 270.2 | 9.0 | 42.3 |
| | L | 800° F. | 51.5 | 215.8 | 221.1 | 15.6 | 58.8 |
| | | | 51.5 | 213.9 | 218.5 | 14.1 | 58.5 |
| | | | 51.5 | 214.7 | 220.8 | 14.9 | 59.0 |
| 6.25 in. | L | R.T. | 50.5 | — | 260.4 | 11.7 | 45.9 |
| | | | 50.5 | 229.5 | 260.3 | 12.1 | 48.0 |
| | | | 50.5 | 228.6 | 260.3 | 11.7 | 43.2 |
| | T | R.T. | 51.5 | — | 266.3 | 7.3 | 31.4 |
| | | | 51.5 | 237.6 | 267.8 | 5.0 | 17.4 |
| | | | 51.5 | 238.6 | 268.6 | 6.2 | 24.4 |
| | L | 800° F. | 50.5 | 200.8 | 214.5 | 14.9 | 58.0 |
| | | | 50.5 | 202.5 | 214.7 | 13.6 | 56.3 |
| | | | 50.5 | 200.4 | 215.8 | 15.0 | 56.7 |
| | T | 800° F. | 51.5 | 212.3 | 218.9 | 11.3 | 41.2 |
| | | | 51.5 | 214.7 | 219.0 | 10.2 | 33.7 |
| | | | 51.5 | 213.5 | 220.1 | 12.0 | 38.8 |

Table V illustrates the good combination of strength and ductility characteristic of the present alloy at room and elevated temperatures.

By way of comparison a heat of type H13 alloy having the composition shown in Table VI in weight percent was prepared similarly to the example of the present invention. Individual samples of the H13 heat.

TABLE VI

| | |
|---|---|
| C | 0.37 |
| Mn | 0.34 |
| Si | 1.04 |
| P | 0.017 |
| S | 0.004 |
| Cr | 5.12 |
| Ni | 0.26 |
| Mo | 1.31 |
| Cu | 0.06 |
| V | 0.95 |
| Fe | Bal. |

were austenitized in salt for 25 minutes at 1875 F., the preferred austenitizing temperature for H13, and air cooled. The as-quenched samples were tempered for 2h +2h at the temperature shown in Table VII. The as-tempered hardness readings indicated in Table VII for each sample are given as Rockwell C scale hardness (HRC) and represent the average of five readings on each sample.

TABLE VII

| Tempering Temp. (°F.) | HRC @ 2 h + 2 h |
|---|---|
| 900 | 54.5 |
| 1000 | 54.0 |
| 1050 | 52.0 |
| 1100 | 48.0 |
| 1150 | 40.5 |
| 1200 | 33.5 |

A comparison of the data in Table VII to that shown in Table II shows the better temper resistance of the present alloy compared to type H13 alloy above 1100 F., thereby illustrating its superiority for hot extrusion die applications.

The alloy of the present invention is well suited for making tools and other articles for use in hot work applications, including dies and mandrels for extrusion of materials such as copper and brass. The alloy has better temper resistance above 1100 F. and better wear resistance than type H13 alloy, thus making it particularly advantageous for use in the extrusion of copper and brass. The alloy also has better toughness and ductility than type H10 or type H21 alloys thereby making it more desirable for use in water cooled, extrusion mandrels. The alloy of the present invention should therefore be more economical to use than the aforementioned alloys because the unique combination of temper resistance, wear resistance, toughness and ductility, together with the high hardness and strength characteristic of the present alloy will tend to prolong the life of tools and other articles formed from the alloy.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention claimed.

What is claimed is:

1. A hot work tool steel alloy having good temper resistance, in combination with good wear resistance and toughness, said alloy, in weight percent, consisting essentially of about

| | w/o |
|---|---|
| Carbon | 0.55 Max. |
| Manganese | 1.5 Max. |
| Silicon | 2.0 Max. |
| Chromium | 3.5–6.0 |
| Molybdenum | 1.5–2.25 |
| Vanadium | 0.50–1.50 |

and the balance essentially Iron wherein % carbon≧0.09×% chromium.

2. An alloy as recited in claim 1 which contains at least about 0.32% carbon.

3. An alloy as recited in claim 1 further containing up to about 0.50 w/o Max. tungsten in substitution for some molybdenum in the ratio 2:1 by weight percent.

4. An alloy as recited in claim 1 which contains not more than about 5.75% max. chromium.

5. An alloy as recited in claim 4 which contains at least about 1.65% molybdenum.

6. An alloy as recited in claim 5 which contains about 0.55–1.25% vanadium.

7. A hot work tool steel alloy having good temper resistance, in combination with good wear resistance and toughness, said alloy, in weight percent, consisting essentially of about

| | w/o |
|---|---|
| Carbon | 0.55 max. |
| Manganese | 1.5 max. |
| Silicon | 2.0 max. |
| Chromium | 3.50–5.75 |
| Molybdenum | 1.65–2.25 |
| Vanadium | 0.55–1.25 |

and the balance essentially Iron wherein % carbon≧0.09×% chromium.

8. An alloy as recited in claim 7 which contains at least about 0.32% carbon.

9. An alloy as recited in claim 7 which contains at least about 1.80% molybdenum.

10. An alloy as recited in claim 9 which contains about 3.75–5.00% chromium.

11. An alloy as recited in claim 10 which contains about 0.60–1.00% vanadium.

12. An alloy as recited in claim 11 which contains about 0.45% max. carbon.

13. An alloy as recited in claim 7 which contains up to about 0.50 w/o max. tungsten in substitution for some molybdenum in the ratio 2:1 by weight percent.

14. An article for extruding metals in the temperature range 1200–2000 F., said article when hardened and tempered having good resistance to heat softening and abrasion in addition to having high hardness and toughness, said article formed of an alloy consisting essentially of, in weight percent, about

| | w/o |
|---|---|
| Carbon | 0.55 Max. |
| Manganese | 1.5 Max. |
| Silicon | 2.0 Max. |
| Chromium | 3.5–6.0 |
| Molybdenum | 1.5–2.25 |
| Vanadium | 0.50–1.50 |

and the balance essentially Iron and wherein % carbon≧0.09×% chromium.

15. An article as recited in claim 14 in which the alloy contains at least about 0.32% carbon.

16. An article as recited in claim 14 in which the alloy contains up to about 0.50 w/o Max. tungsten in substitution for some molybdenum in the ratio 2:1 by weight percent.

17. An article as recited in claim 14 in which the alloy contains about 5.75% max. chromium.

18. An article as recited in claim 17 in which the alloy contains at least about 1.65% molybdenum.

19. An article as recited in claim 18 in which the alloy contains about 0.55–1.25% vanadium.

20. An article as recited in claim 19 in which the alloy contains about 0.45% max. carbon.

21. An article as recited in claim 17 in which the alloy contains at least about 1.80% molybdenum.

22. An article as recited in claim 21 in which the alloy contains about 3.75–5.00% chromium.

23. An article as recited in claim 14 having a Rockwell C hardness of at least 50 and a Charpy V-notch impact strength at mid-radius of at least 5 ft-lb when austenitized at 1875–1925 F. (1025–1050 C.), quenched in oil and then tempered at a combination of temperature and time equivalent to 1100 F. (595 C.) for two successive periods of two hours each.

* * * * *

UNITED STATES PATENT AND TRADEMARK OFFICE

CERTIFICATE OF CORRECTION

PATENT NO. : 4,886,640

DATED : December 12, 1989

INVENTOR(S) : HARRISON A. GARNER, JR. et al.

It is certified that error appears in the above-identified patent and that said Letters Patent is hereby corrected as shown below:

Abstract,

Line 18, "0.098" should be --0.09--.

Column 4,

Line 61, after "a" delete ".".

Signed and Sealed this

Ninth Day of October, 1990

*Attest:*

HARRY F. MANBECK, JR.

*Attesting Officer*

*Commissioner of Patents and Trademarks*